US009038276B2

(12) United States Patent
Arndt et al.

(10) Patent No.: US 9,038,276 B2
(45) Date of Patent: May 26, 2015

(54) HAIR CLIPPER WITH A ROTARY MOTOR VIBRATION AND NOISE DAMPER

(71) Applicants: Steven Arndt, Geneseo (IL); Jeff Gesiakowski, Sterling, IL (US)

(72) Inventors: Steven Arndt, Geneseo (IL); Jeff Gesiakowski, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 315 days.

(21) Appl. No.: 13/840,315

(22) Filed: Mar. 15, 2013

(65) Prior Publication Data

US 2014/0259691 A1 Sep. 18, 2014

(51) Int. Cl.

| | |
|---|---|
| ***B26B 19/06*** | (2006.01) |
| ***B26B 19/28*** | (2006.01) |
| ***B26B 19/38*** | (2006.01) |

(52) U.S. Cl.

CPC ..... *B26B 19/06* (2013.01); *B26B 19/3866* (2013.01); *B26B 19/28* (2013.01); *B26B 19/3853* (2013.01)

(58) Field of Classification Search

CPC ..... B26B 19/06; B26B 19/28; B26B 19/38; B26B 19/3853; B26B 19/3866

USPC ..... 30/194–204, 208–210, 215–220

See application file for complete search history.

(56) References Cited

U.S. PATENT DOCUMENTS

| | | | | |
|---|---|---|---|---|
| 3,589,007 | A * | 6/1971 | Walton | 30/210 |
| 3,805,136 | A | 4/1974 | Meyer et al. | |
| 3,842,498 | A * | 10/1974 | Mizobata et al. | 30/220 |
| 4,383,366 | A | 5/1983 | Andis | |
| 4,498,237 | A * | 2/1985 | Mack et al. | 30/216 |
| 4,542,585 | A * | 9/1985 | Ito et al. | 30/210 |
| 4,651,761 | A * | 3/1987 | Suen et al. | 30/210 |
| 4,723,362 | A * | 2/1988 | Boerger | 30/218 |
| 5,165,172 | A * | 11/1992 | Weinrauch | 30/210 |
| 6,098,288 | A * | 8/2000 | Miyagawa et al. | 30/210 |
| 6,141,878 | A * | 11/2000 | Eslambolchi et al. | 30/216 |
| 6,369,341 | B2 * | 4/2002 | Katsumi | 200/302.2 |
| 7,346,990 | B2 | 3/2008 | Dirks et al. | |
| 7,690,117 | B2 * | 4/2010 | Rogatschnig | 30/43.2 |
| 7,698,822 | B2 * | 4/2010 | Kostner et al. | 30/216 |
| 7,748,123 | B2 * | 7/2010 | Bednar | 30/216 |
| 8,418,369 | B1 * | 4/2013 | Laube | 30/216 |
| 8,769,824 | B2 * | 7/2014 | Heerlein et al. | 30/216 |
| 2002/0153863 | A1 * | 10/2002 | Arndt | 320/115 |
| 2003/0131480 | A1 * | 7/2003 | Leung et al. | 30/210 |
| 2003/0145469 | A1 * | 8/2003 | Ogawa et al. | 30/210 |

(Continued)

FOREIGN PATENT DOCUMENTS

GB 2190868 A * 12/1987

OTHER PUBLICATIONS

Wahl Contour hair clipper introduced in 2000.

(Continued)

*Primary Examiner* — Jason Daniel Prone

(74) *Attorney, Agent, or Firm* — Greer Burns & Crain Ltd.

(57) ABSTRACT

A hair clipper has a base structural housing with a blade set operably secured thereto. The blade set has a stationary blade and a reciprocating blade. The base has at least one support for a rotary motor. A flexible motor vibration and noise damper fits over half of the motor, and a motor cover is secured to the base structural housing over the vibration damper. A secondary housing cover is secured to the base structural housing over the motor cover.

9 Claims, 3 Drawing Sheets

(56) References Cited

U.S. PATENT DOCUMENTS

| | | | | |
|---|---|---|---|---|
| 2005/0060893 | A1* | 3/2005 | Comminges | 30/216 |
| 2006/0011028 | A1* | 1/2006 | Andis et al. | 30/216 |
| 2006/0283022 | A1* | 12/2006 | Oh | 30/216 |
| 2007/0214654 | A1* | 9/2007 | Chen et al. | 30/210 |
| 2008/0155834 | A1* | 7/2008 | Li et al. | 30/210 |
| 2010/0325892 | A1* | 12/2010 | Nuber | 30/34.1 |
| 2014/0310962 | A1* | 10/2014 | Ziegler et al. | 30/216 |
| 2014/0352159 | A1* | 12/2014 | Arndt et al. | 30/216 |

OTHER PUBLICATIONS

Wahl Contour Beret hair trimmer introduced in 2002.
Wahl Proficient hair clipper introduced in 2012.

* cited by examiner

HAIR CLIPPER WITH A ROTARY MOTOR VIBRATION AND NOISE DAMPER

This invention relates to hair clippers, and more particularly to motor vibration and noise dampening for hair clippers driven by a rotary motor with an eccentric cam mechanism converting rotary motion into linear motion of a reciprocating blade.

BACKGROUND OF THE INVENTION

Many hand held tools are designed to hold or support a motor in a rigid housing around the motor's front and rear motor bearings. To suppress vibration transferring to the housings, a thin rubber collar is used around the circumference of the bearings. For additional vibration reduction, a piece of sponge rubber is often used between the motor and housing under light compression. However, if the housing is significantly larger than the motor (creating a large dead air space) or the motor has significant clearance between the shaft and bearing, the motor vibration tends to resonate inside the housing causing amplified noise. Both vibration and noise are undesirable.

Vibration and noise occur in rotary motor hair clippers, where an eccentric cam drives a blade along a linear reciprocating path. The eccentricity of the cam causes resonant frequencies at the points of contact between the motor and the housing, and transfers energy into vibration and noise that the user feels while the hair clipper is in use.

Thus, there is a need for vibration dampening for hair clippers that use rotary motors to reduce motor and housing vibrations of the hair clipper.

There is also a need for vibration dampening for hair clippers having rotary motors that better reduce noise generated by operation of the hair clipper.

SUMMARY OF THE INVENTION

In keeping with one aspect of the invention, a hair clipper has a base structural housing with a blade set operably secured thereto. The blade set has a stationary blade and a reciprocating blade. The base structural housing also has at least one support for a rotary motor. The rotary motor has a shaft extending between a front bearing and a back bearing of the motor, and the shaft has a cam near the front bearing for driving the reciprocating blade.

A flexible motor vibration damper fits over half of the motor, and a motor cover is secured to the base structural housing over the vibration damper. A secondary housing cover is secured to the base structural housing over the motor cover.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
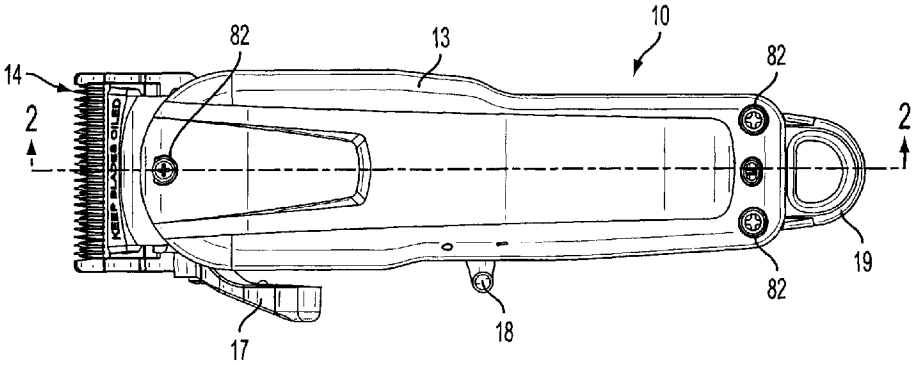
FIG. 1 is a top view of one embodiment of a hair clipper.
Figure 3:
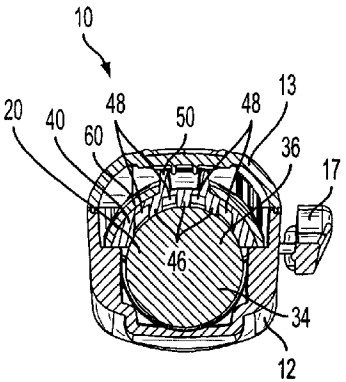
FIG. 3 is another cut-a-way view of the hair clipper of FIG. 1, taken along lines 3-3 of FIG. 2.
Figure 2:
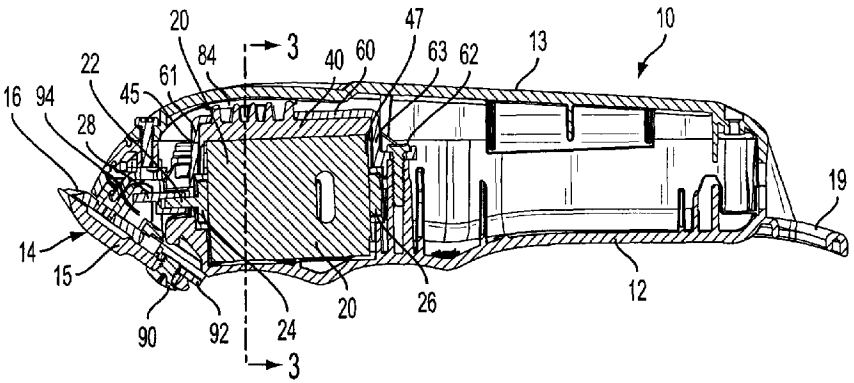
FIG. 2 is a cut-a-way view of the hair clipper of FIG. 1, taken along lines 2-2.

As seen in FIGS. 1, 2 and 3, a hair clipper 10 has a base structural housing 12 and a secondary housing cover 13. The base structural housing 12 and the secondary housing cover 13 can be relatively simple in construction, but preferably are not prone to excessively vibrate, resonate or amplify noise.

A blade set 14 includes a stationary blade 15 and a reciprocating blade 16. A blade depth adjuster 17, a motor switch 18 and a clipper hanger hook 19 are provided. A power source such as a battery or line cord and appropriate wiring (not shown) are also provided.

A rotary motor 20 has a shaft 22 (FIG. 4) extending through the motor 20 between a front bearing 24 (FIG. 2) and a rear bearing 26. A rubber collar 29 can be provided over each of the bearings to absorb vibration and reduce noise. The shaft 22 has a cam 28 near the front bearing 24 for driving the reciprocating blade 16.

Figure 5:
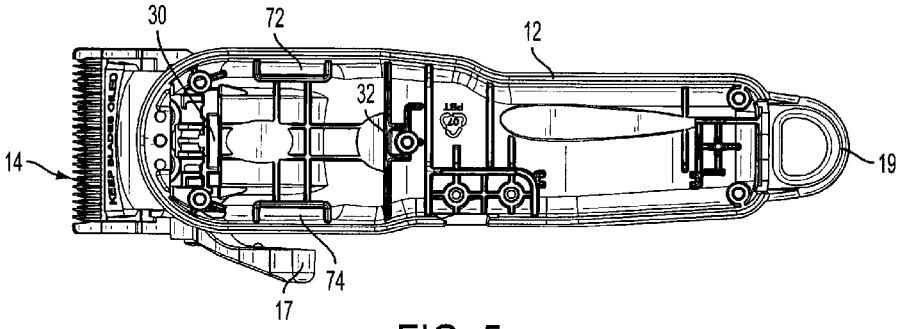
FIG. 5 is a top view of the base structural housing of the hair clipper of FIG. 1.

Turning briefly to FIG. 5, the base structural housing 12 has at least one support for the motor 20, such as a first support 30 for the front bearing 24, and a second support 32 for the back bearing 26.

Returning to FIG. 3, the motor 20 has a base side 34 and a cover side 36. The base side 34 is supported by the supports 30, 32 (FIG. 5) in base structural housing 12.

A flexible motor vibration damper 40 fits over the cover side 36 of the motor 20. The damper 40 is preferably made of flexible rubber or plastic material that absorbs vibration and reduces noise.

Figure 6A:
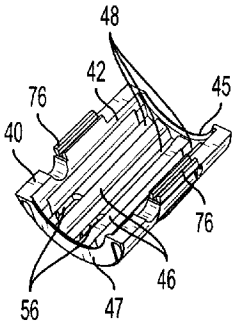
FIG. 6A is a perspective view of the vibration damper used in the hair clipper of FIG. 1.

The vibration damper 40 has an inside surface 42 (FIG. 6A), an outside surface 44 (FIG. 4), and motor face flanges 45, 47 (FIG. 2). The motor face flanges 45, 47 better position and stabilize the vibration damper 40 over the motor 20.

On the inside surface 42, the vibration damper 40 has a plurality of spaced ribs 46 (FIG. 3) oriented parallel to the shaft 22 or at any other suitable angle or configuration. The ribs 46 form channels 48 in the vibration damper 40. Among other things, the channels 48 allow the ribs 46 to compress and spread over the motor 20.

The vibration damper 40 also has a raised portion 50 (FIGS. 3 and 4) on the outside surface 44. The raised portion 50 has an oval shaped outer ring 52, with internal ribs 54 extending across the oval shaped outer ring 52.

Figure 4:
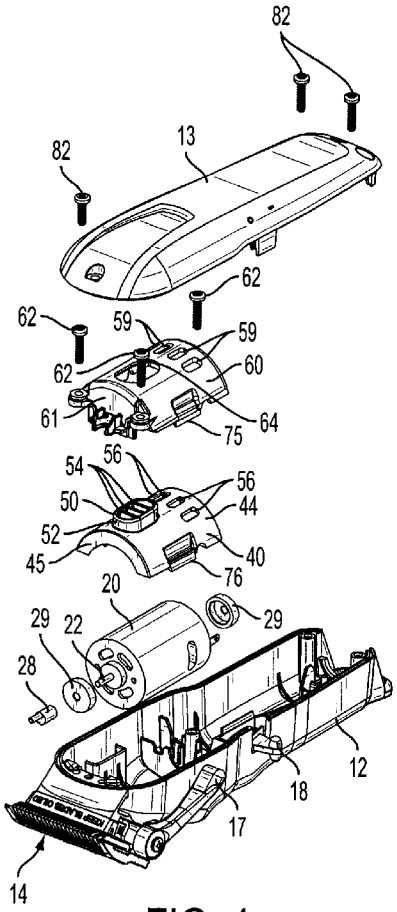
FIG. 4 is an exploded view of the hair clipper of FIG. 1.
Figure 6B:
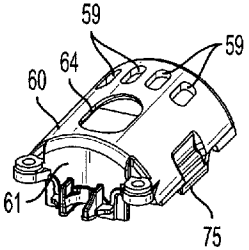
FIG. 6B is a perspective view of the motor cover used in the hair clipper of FIG. 1.

A plurality of openings 56 can be provided in the vibration damper 40. Heat from the motor 20 is dissipated through the channels 48, the openings 56 and corresponding openings 59 in a motor cover 60 (FIGS. 4 and 6B).

The motor cover 60 is secured to the base structural housing 12 by a plurality of fasteners 62. The motor cover 60, which is preferably rigid, is secured to the base structural housing 12 over the vibration damper 40, compressing the damper 40 over the motor 20. The motor cover 60 includes an opening 64 through which the protrusion 50 on the top of the vibration damper 40 passes. The motor cover 60 also has side surfaces 61, 63 that cover the motor face flanges 45, 47 and openings for the fasteners 62.

The vibration damper 40 includes a pair of protrusions 76 (FIG. 6A) that fit into the slots 72, 74 (FIG. 5) for positioning and securing the vibration damper 40 over the cover side 36 of the motor 20. The motor cover 60 has fingers 75 (FIG. 6B) that also fit in the slots 72, 74. The protrusions 76 and the fingers 75 stiffen the sides of the housing base 12 when the protrusions 76 and fingers 75 are in the slots 72, 74, which further dampens vibrations.

Figure 7:
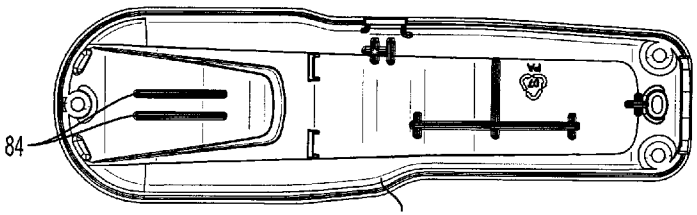
FIG. 7 is an inside view of the secondary housing cover using the hair clipper of FIG. 1.

The secondary housing cover 13 is secured to the base structural housing 12 by fasteners 82 (FIG. 1). When installed, the secondary housing cover 13 encloses the motor 20, the vibration damper 40 and the motor cover 60. Ribs 84 (FIG. 7) can be provided adjacent the protrusion 50, to compress the ribs 54 against the oval ring 52 in the protrusion 50. Contact with the protrusion 50 reduces vibrations in the secondary housing cover 13.

Figure 8:
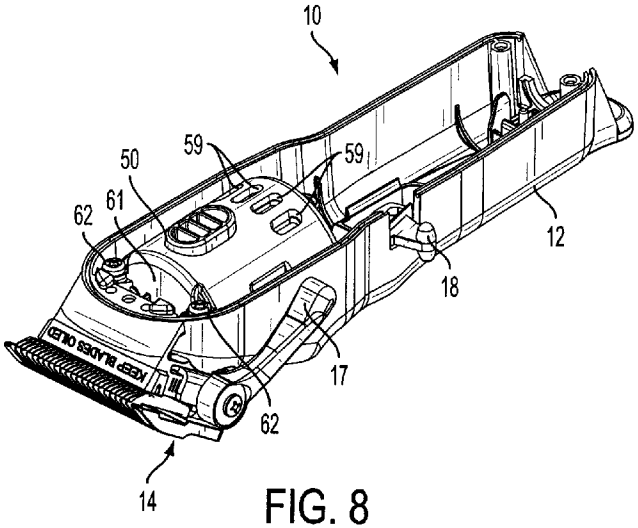
FIG. 8 is a perspective view of the hair clipper of FIG. 1, with the secondary housing cover and power source removed.

Assembly of the hair clipper 10 can be best understood with reference to FIGS. 4 and 8. The rubber mounts 29 are placed over the shaft 22 and bearings 24, 26 of the motor 20, and the cam 28 is secured to a front end of the shaft 22. The motor 20 is installed in the base structural housing 12 over the supports 30, 32.

The blade set 14 is also secured to the base structural housing 12 with suitable fasteners 90. In FIG. 2, the stationary blade 14 is fastened to a blade depth adjusting bracket 92, which in turn is adjustably secured to the base structural housing 12. When the motor 20 is installed in the base structural housing, the cam 28 operably engages a cam follower 94, which in turn engages the reciprocating blade 16.

Referring again to FIG. 4 and FIG. 5, the protrusions 76 in the vibration damper 40 are placed in the slots 72, 74 of the base structural housing 12, and the cover 60 is placed over the vibration damper 40. When installed, the fingers 75 of the motor cover 60 are also in the slots 72, 74 and the protrusion 50 on the top of the vibration damper 40 passes through the opening 64 of the motor cover 60, as seen in FIG. 8. The openings 56 in the vibration damper 40 and the openings 59 in the motor cover 60 are aligned for ventilation purposes. The motor cover 60 is then secured to the base structural housing 12 by the fasteners 62, as also seen in FIG. 8. The secondary housing cover 13 is then secured to the base structural housing 12 by the fasteners 82 (FIG. 1).

The advantages of this invention are now apparent. Both vibration and noise are reduced as compared with the vibration and noise generated by conventional hair clippers.

While the principles of the invention have been described above in connection with specific apparatus and applications, it is to be understood that this description is made only by way of example and not as a limitation on the scope of the invention.

What is claimed is:

1. A hair clipper having:

a base structural housing with a blade set operably secured thereto, the blade set having a stationary blade and a reciprocating blade, a rotary motor having a shaft extending through the motor between a front bearing and a back bearing of the motor, the shaft having a cam near the front bearing for driving the reciprocating blade, the base structural housing having at least one support for the motor, the motor further having a base side and a cover side, the base side being supported by the at least one support in the base structural housing, a flexible motor vibration damper formed to fit over the cover side of the motor, a motor cover secured to the base structural housing over the vibration damper, and a secondary housing cover secured to the base structural housing over the motor cover.

2. The hair clipper of claim 1, wherein the vibration damper has:

an inside surface that faces the motor and an outside surface that faces the motor cover, and a plurality of spaced ribs on the inside surface, and the ribs defining channels therebetween.

3. The hair clipper of claim 2, wherein the vibration damper has a raised portion on the outside surface, the motor cover has an opening through which the raise portion of the vibration damper passes, and the raised portion being compressed against the secondary housing cover to reduce vibrations in the secondary housing cover.

4. The hair clipper of claim 3, wherein the secondary housing cover has at least one rib adjacent the raised portion.

5. The hair clipper of claim 2, wherein the vibration damper has a plurality of openings for dissipating heat.

6. The hair clipper of claim 5, wherein the motor cover has motor cover openings corresponding to the heat dissipation openings in the vibration damper.

7. The hair clipper of claim 2, wherein the base structural housing has a pair of slots located adjacent opposing sides of the base structural housing, and the vibration damper has a first pair of protrusions that respectively fit into the slots in the base structural housing for positioning the vibration damper over the cover side of the motor.

8. The hair clipper of claim 7, wherein the motor cover has a second pair of protrusions that respectively fit into the slots in the base structural housing for positioning the motor cover over the vibration damper.

9. The hair clipper of claim 8, wherein the first pair of protrusions and the second pair of protrusions stiffen the base structural housing when respectively received by the slots.

* * * * *